US007811422B2

(12) United States Patent
Zimmerman

(10) Patent No.: US 7,811,422 B2
(45) Date of Patent: Oct. 12, 2010

(54) ELECTRO-CHEMICAL PROCESSOR WITH WAFER RETAINER

(75) Inventor: Nolan L. Zimmerman, Kalispell, MT (US)

(73) Assignee: Semitool, Inc., Kalispell, MT (US)

( * ) Notice: Subject to any disclaimer, the term of this patent is extended or adjusted under 35 U.S.C. 154(b) by 911 days.

(21) Appl. No.: 11/674,912

(22) Filed: Feb. 14, 2007

(65) Prior Publication Data

US 2008/0190757 A1 Aug. 14, 2008

(51) Int. Cl.
*C25D 17/00* (2006.01)

(52) U.S. Cl. ..... 204/199; 204/297.01

(58) Field of Classification Search ..... 204/199, 204/212, 297.01

See application file for complete search history.

(56) References Cited

U.S. PATENT DOCUMENTS 6,167,893 B1 * 1/2001 Taatjes et al. ..... 134/147
6,273,484 B1 * 8/2001 Peng ..... 294/86.4
6,333,275 B1 12/2001 Mayer
6,537,416 B1 3/2003 Mayer
7,118,658 B2 * 10/2006 Woodruff et al. ..... 204/242
2005/0189213 A1 9/2005 Woodruff

* cited by examiner

*Primary Examiner*—Luan V Van
(74) *Attorney, Agent, or Firm*—Kenneth H. Ohriner; Perkins Coie LLP

(57) ABSTRACT

A wafer plating apparatus has a rotor in a head including wafer retainers which properly hold a wafer on the rotor in position. A seal on the head seals plating bath liquid away from the edges of the wafer. After plating is completed and the wafer is moved away from the seal, the wafer retainers prevent the wafer from sticking to the seal. The rotor may include a backing plate adapted to support a wafer during processing, with the wafer retainers pivotally attached to the backing plate. Movement of the backing plate relative to a seal may move the wafer retainers between open and closed or engaged positions.

15 Claims, 8 Drawing Sheets

ELECTRO-CHEMICAL PROCESSOR WITH WAFER RETAINER

BACKGROUND

Microelectronic circuits use metal films or layers for a wide range of purposes. For example, metal layers may be used to electrically interconnect the various components on a workpiece, such as the components formed in a semiconductor wafer. Further, the metal layers may be used to form the actual electronic components on the workpiece. The metal layers are typically applied onto the wafer in an electroplating processor.

Electroplating involves immersing an electrically conductive surface, such as a metal seed layer, on the device side of the wafer into a plating bath. The electrically conductive surface forms a current path between an immersed electrode and electrical contacts touching the electrically conductive surface around the edge of the wafer. Metal is deposited on the workpiece from the electrolyte (electroplating) or removed from the workpiece (electropolishing/etching), depending on the direction of the current flow.

Terminal effects resulting from non-uniform current flow at the edges of the wafer, and the irregular geometry of the wafer edge, can cause non-uniform plating at the edges of the wafer. Accordingly, metal plated onto the edges of the wafer is more prone to breaking or flaking off of the wafer, creating contaminant particles. Semiconductor wafers are also generally handled or supported by their edges. Hence, metal plated onto the wafer at the wafer edges can be a serious source of potential contamination. For these reasons, electroplating metal at the edges is generally avoided. In practice, an annular seal in the head of the electroplating processor is typically held against the wafer during electroplating, to seal the plating bath liquid away from the wafer edges. After electroplating, the seal is moved away from the wafer, or vice versa. However, in some cases, the wafer may tend to stick to the seal. This creates risk of damage to the wafer, and can also slow the manufacturing process. Accordingly, improvements in wafer handling in electroplating processing are needed.

SUMMARY

The inventor has now developed a novel processing apparatus which overcomes the problems inherent in currently used apparatus. With this new apparatus, wafer retainers may operate automatically to ensure that the wafer separates from the seal at the completion of processing. Manufacturing of semiconductor and similar devices is accordingly improved.

In one aspect, apparatus may include a backing plate adapted to support a wafer during processing. Wafer retainers can be attached to the backing plate. Movement of the backing plate relative to a seal may move the wafer retainers between open and closed or engaged positions.

In another aspect, a ring supporting the seal has an inwardly angled surface. As the backing plate approaches the seal, a first end of the wafer retainers contact the inwardly angled surface. This causes the wafer retainers to pivot inwardly, moving fingers on the wafer retainers into engagement with the first side of the wafer. The wafer retainers may include rollers for making rolling contact with the inwardly angled surface. The fingers advantageously contact the wafer at finger positions adjacent to an edge of the wafer, behind or radially outwardly from the seal. The fingers accordingly are not exposed to the plating bath. When the backing plate moves away from the seal, the fingers hold the wafer onto the backing plate. Accordingly, the wafer cannot stick to the seal.

In yet another aspect, as the backing plate moves away from the seal, the wafer retainers move into the open or disengaged position. The movement may be achieved via springs acting on the wafer retainers. Alternatively, this movement may be achieved via a second end of the wafer retainers contacting an outwardly inclined surface.

The invention resides as well in the methods described, and in sub-combinations of the apparatus and elements described.

DETAILED DESCRIPTION

Figure 1:
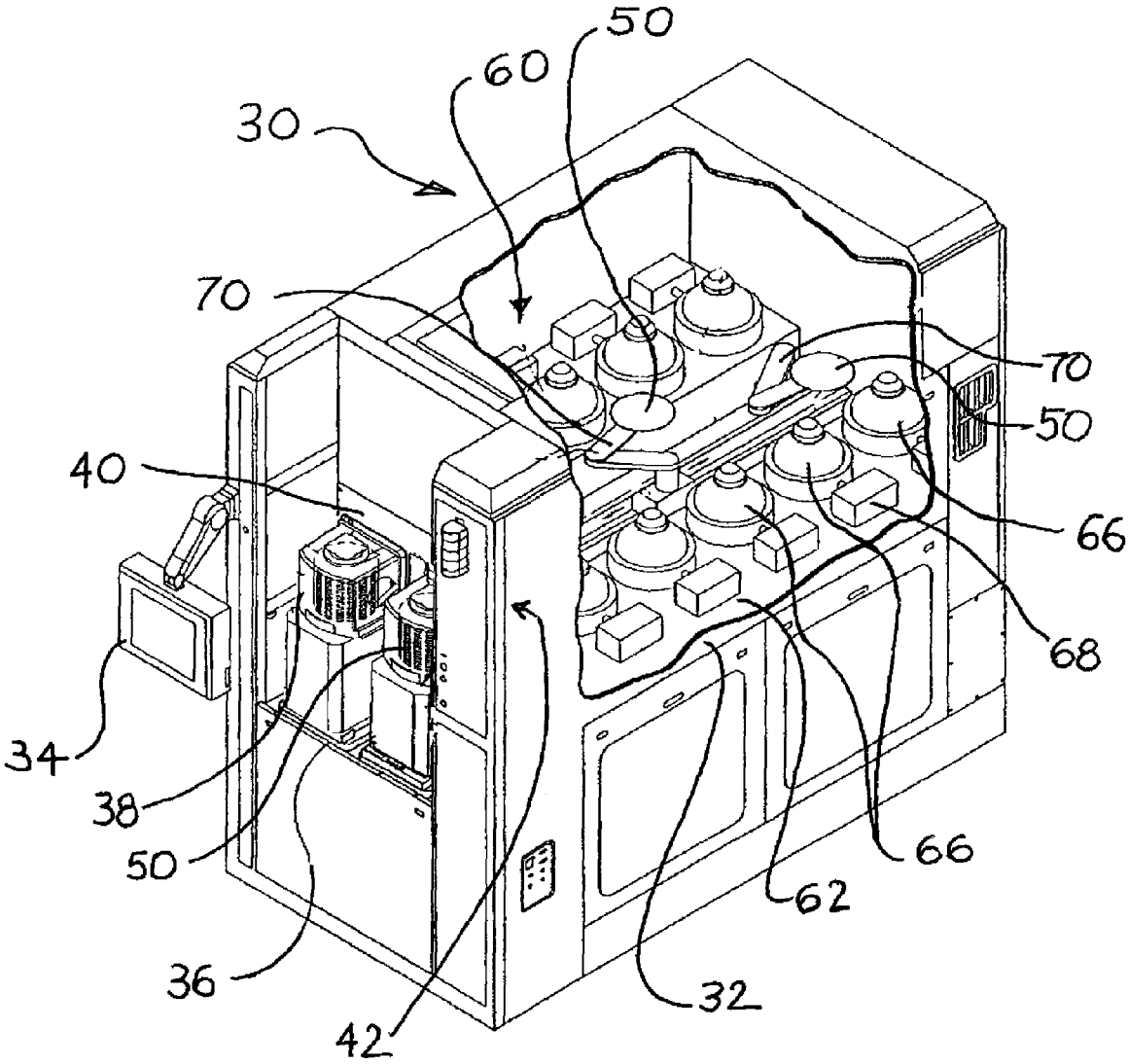
FIG. 1 is a perspective view of a processing system in which the processor of the invention may be used.

The invention is directed to apparatus and methods for processing a workpiece such as a semiconductor material wafer. The term workpiece or wafer here means any flat article, including semiconductor wafers and other substrates, such as glass, mask, and optical or memory medial, MEMS substrates or any other workpiece having, or on which, micro-electronic, micro-mechanical, micro-electro-mechanical, or micro-optical devices, may be formed. Inwardly here means towards the spin axis of the rotor. Inward angle surface means a surface angled towards the spin axis of the rotor, moving from the top to the bottom of the head, regardless of the orientation of the head. Outwardly means away from the spin axis of the rotor. Outward angle surface means a surface angled away from the spin axis of the rotor, moving from the top to the bottom of the head, regardless of the orientation of the head. The term engaged means in a position to interact or cooperate with another element or the workpiece, without necessarily being in actual physical contact with the other element or workpiece. Terms such as upper, lower, top, bottom, and the like when used herein refer to the positions of the respective elements shown in the drawings. The embodiments of the invention however are not necessarily limited to such positions.

FIG. 1 shows an example of a processing system or apparatus 30 where a new processor 66 may be used. The processor 66, as described below, may also be used in other types of systems, or it may be used as a stand alone unit. In the example shown in FIG. 1, multiple processors 66 are aligned in two rows. The processors 60 are supported on a deck 62 within an enclosure 32 of the system 30. The specific system 30 shown has a load/unload section 36 where wafers 50 are provided to the system 30 within containers 38. A docking wall 40 separates the load/unload section 36 from a work-in-progress section (WIP) 42. One or more process robots 70 are moveable between or alongside of the rows.

A WIP robot, not shown, may be provided in the WIP section 42, for moving wafers 50 from the containers 38 to positions within the WIP section 42. Alternatively, this operation may be performed by a process robot 70. A controller 34 may be provided with the system 30, to control and monitor system operations.

Figure 2:
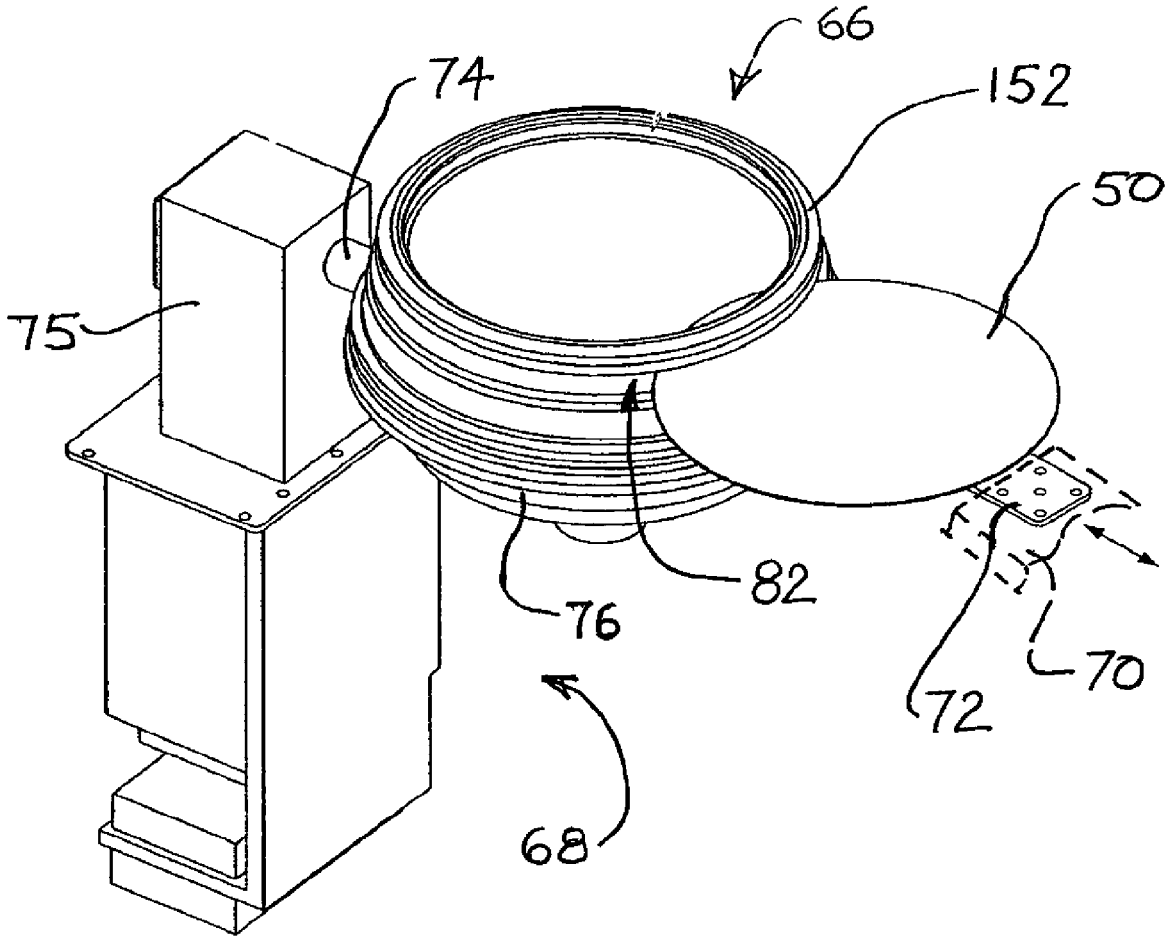
FIG. 2 is a perspective view of the head of a processor in a load/unload position.

Referring now to FIG. 2, in the example shown, the processor 66 has a head 76 for receiving, holding, and rotating a wafer 50. The head 76 may be attached to a lift column 75 of a lift-rotate unit 68, on a rotate arm 74. FIG. 2 shows the head 76 in an inverted or upside down position, for loading and unloading a wafer 50 into the head 76. In FIG. 2, the wafer 50 is moved into the head 76 via an end effector 72 on a process robot 70. The end effector 72 is shown loading a wafer 50 through a load slot 82, the rotor 78 in the head 76.

Figure 3:
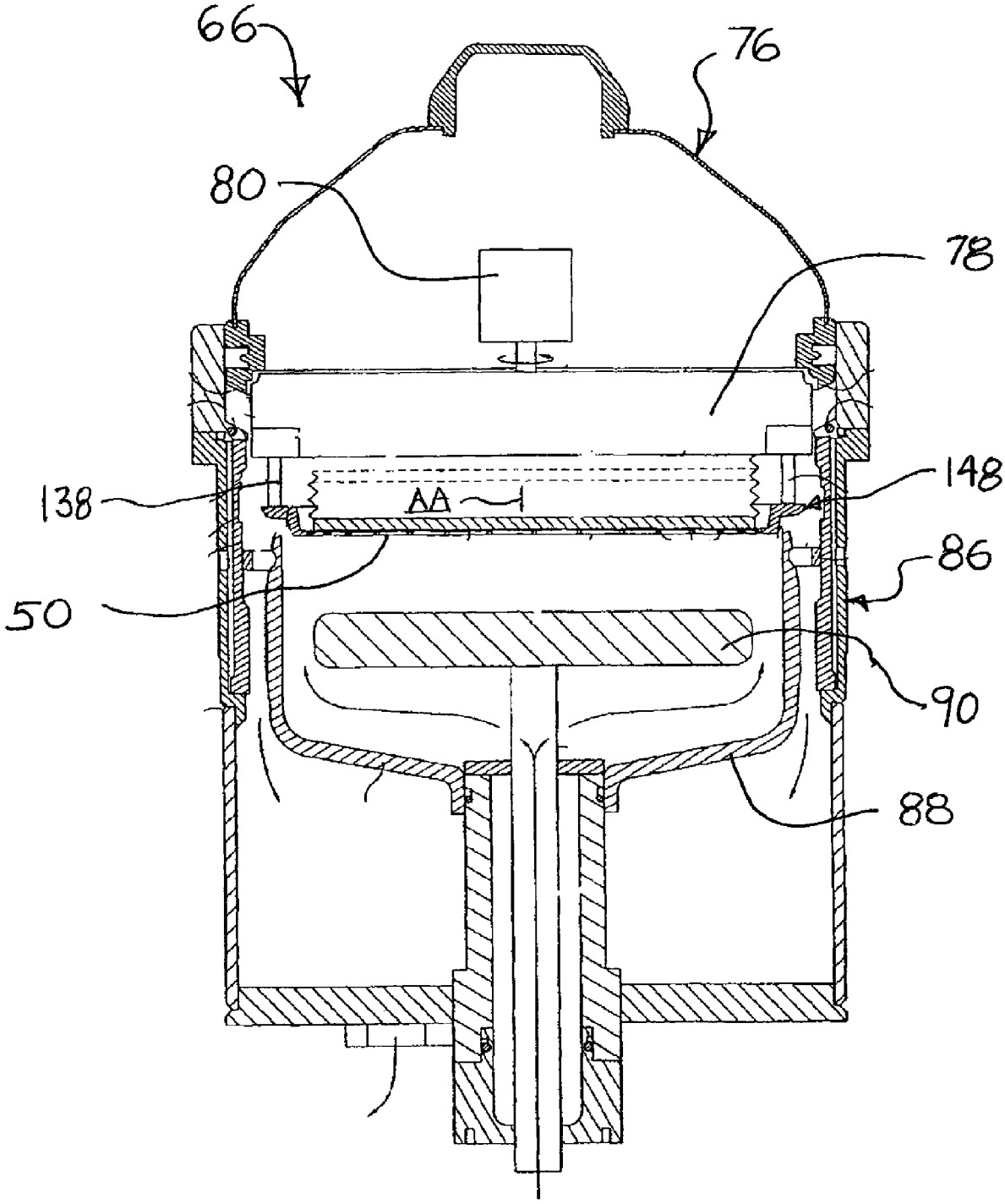
FIG. 3 is a schematic section view of the head shown in FIG. 2 on a base.

As shown in FIG. 3, the head 76 of the processor 66, is moveable into engagement with a base assembly 86, a bowl or vessel 88 for holding a process liquid, e.g., a plating solution, is supported within the base assembly 86. An electrode 90, such as an anode, may be provided in the bowl 88 in various forms. Referring still to FIG. 3, a rotor 78 is rotatably mounted in or on the head 76. A spin motor 80 is attached to the rotor 78, for spinning the rotor during processing. In FIG. 3, the head is shown in the upright position.

Figure 4:
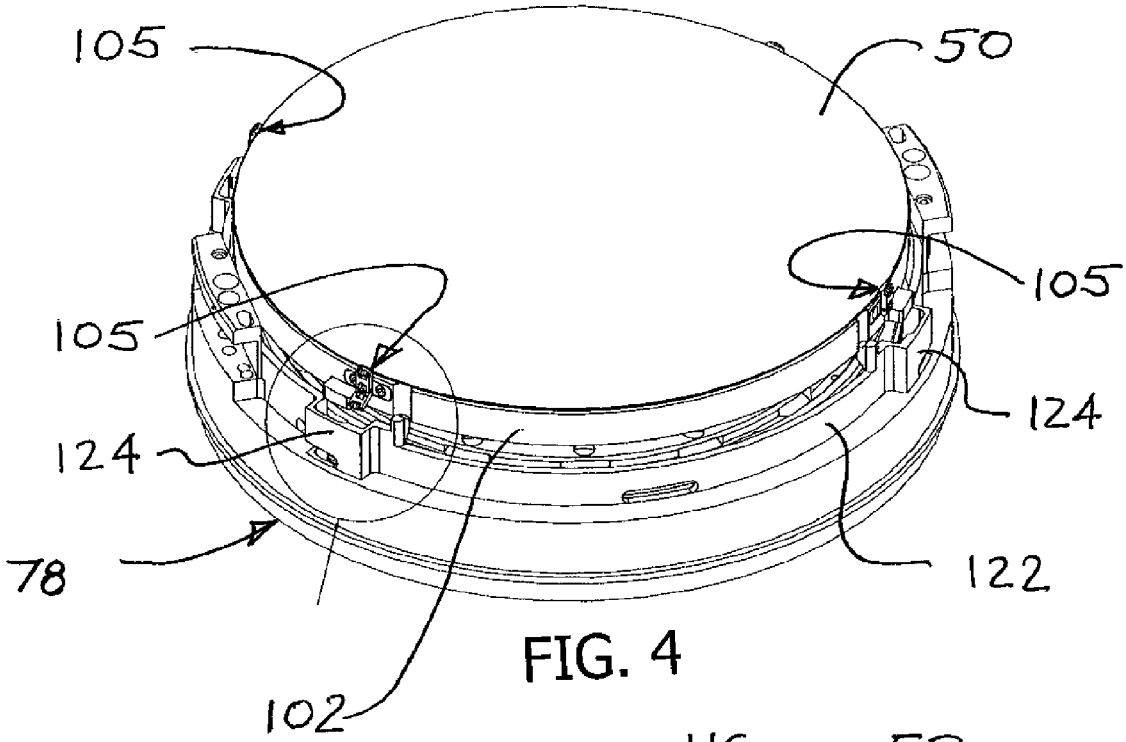
FIG. 4 is a perspective view of the rotor of the head shown in FIG. 2.

FIGS. 4-11 show the rotor 78 in an inverted position, for loading and unloading a wafer 50. Referring to FIG. 4, the rotor 78 includes a backing plate 102 which is moveable along the axis AA shown in FIG. 3, relative to an outer rotor drive housing 122. Wafer retainers 105 are attached to the cylindrical side wall of the backing plate 102. The retainers 105 are spaced apart around the circumference of the backing plate 102. In the example shown in FIG. 4, four retainers 105 are shown. A three-sided retainer housing 124 is provided on the outer drive 122, generally aligned with each retainer 105.

Figure 5:
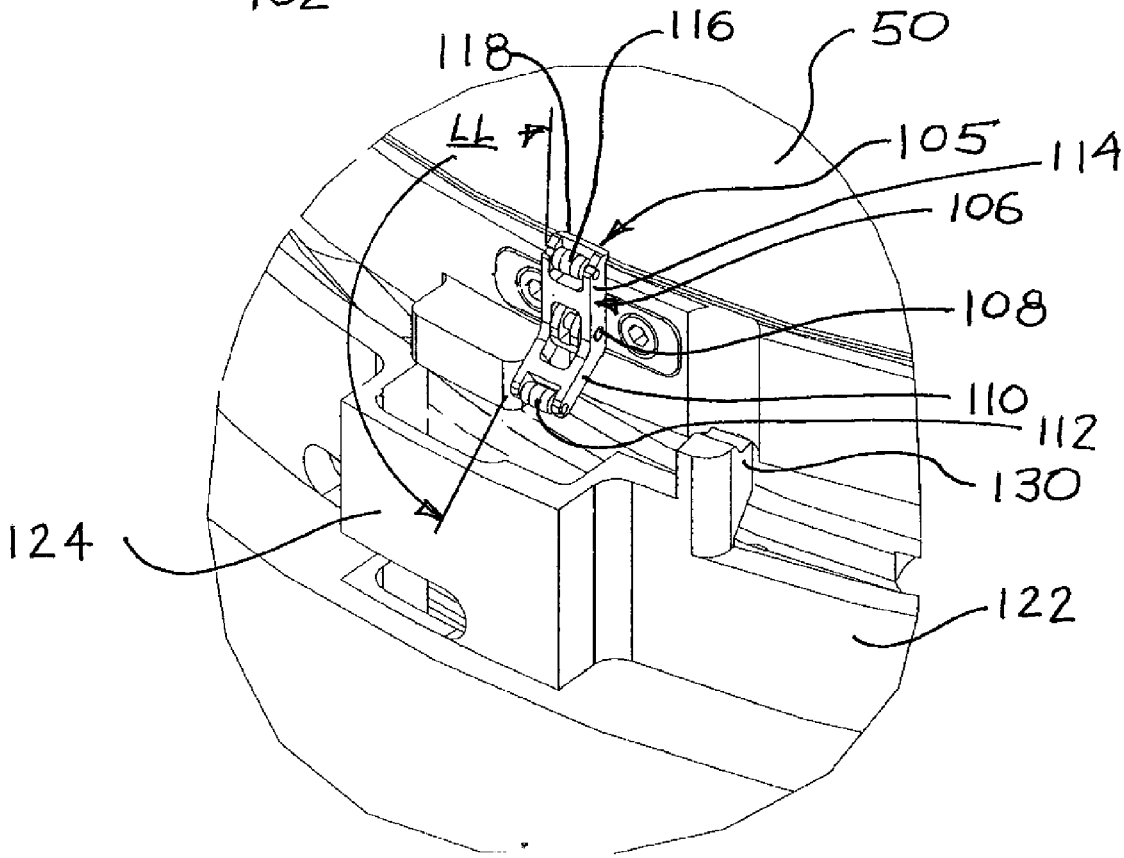
FIG. 5 is a perspective view of the wafer retainers shown in FIG. 4.

As shown in FIG. 5, each retainer 105 may include a lever 106 attached to a clevis 104 at a pivot joint 108. The lever 106 shown has a lower arm 110 extending at an angle LL to the upper arm 114 of the lever 106. Angle LL may range from about 90-150, 100-140, or 110-130 degrees. Rollers 112 and 116, or similar low friction sliding or rolling devices, may be provided at the ends of the lower and upper arms 110 and 114. A finger 118 extends radially inwardly at the upper end of each upper arm 114.

Figure 6:
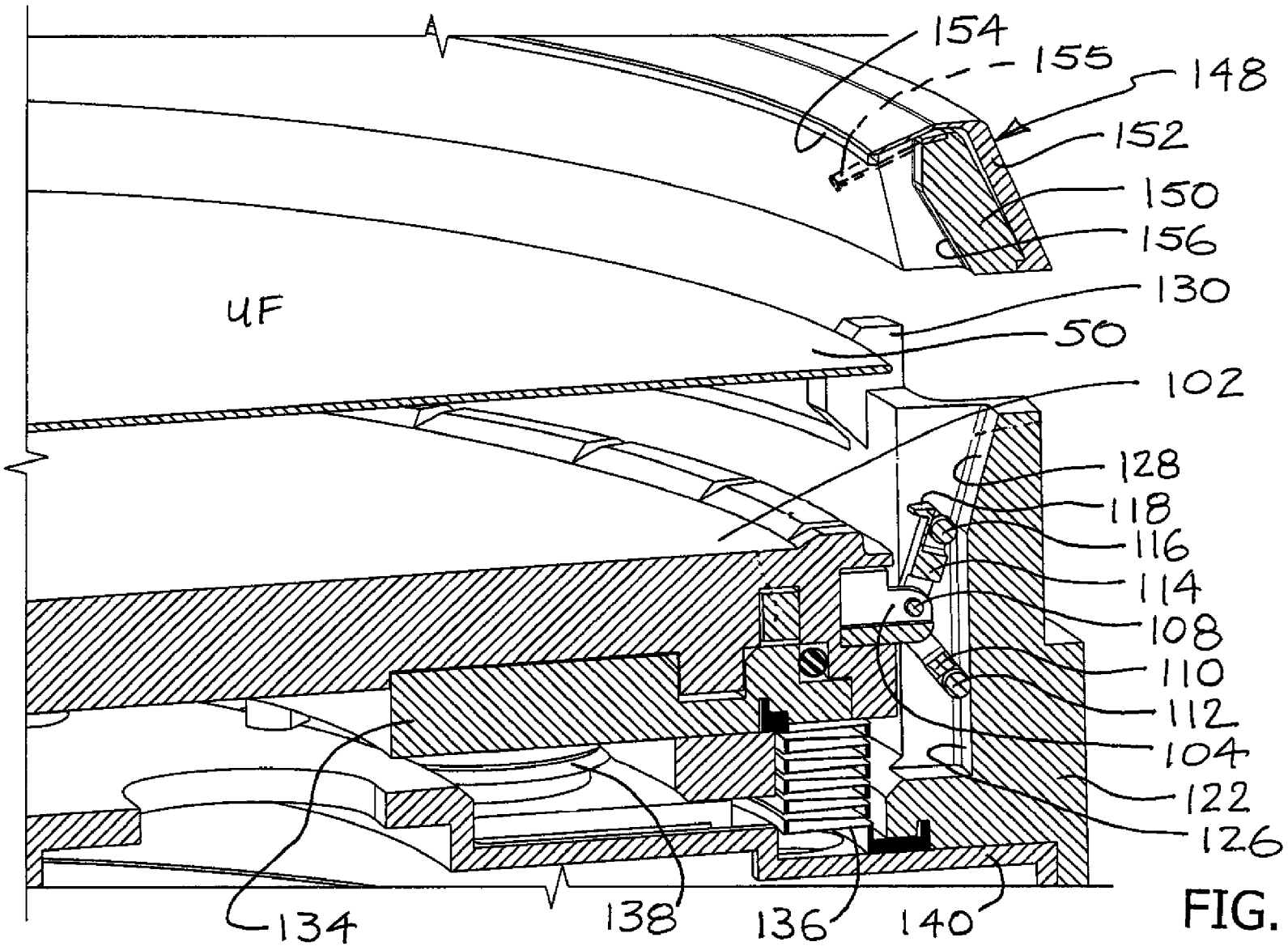
FIG. 6 is an enlarged section view of the rotor shown in FIGS. 4 and 5 with the backing plate withdrawn.

FIGS. 6, 7, and 8 again show the rotor 78 inverted. As shown in FIG. 6, a lower ring assembly 148 is supported, and spaced vertically apart from, the outer drive housing 122. The lower ring assembly 148 in this design is fixed relative to the outer drive housing 122. The lower ring assembly 148 includes a ring contact 150 having electrical contacts 155 which touch the device side of the wafer 50. In FIG. 6, the device side is the up facing side marked UF. Typically, a large number of equally spaced apart contacts 155 are used. For purpose of illustration only, FIG. 6 shows a single contact 155. The contacts may be provided as described in U.S. Pat. No. 6,911,127 B2, incorporated herein by reference. An annular seal 154 extends around an inner diameter of the seal ring 152. The seal 154 is adapted to press and seal against the wafer 50 to confine a processing liquid such as a plating solution or to the device side of the wafer 50.

Figure 7:
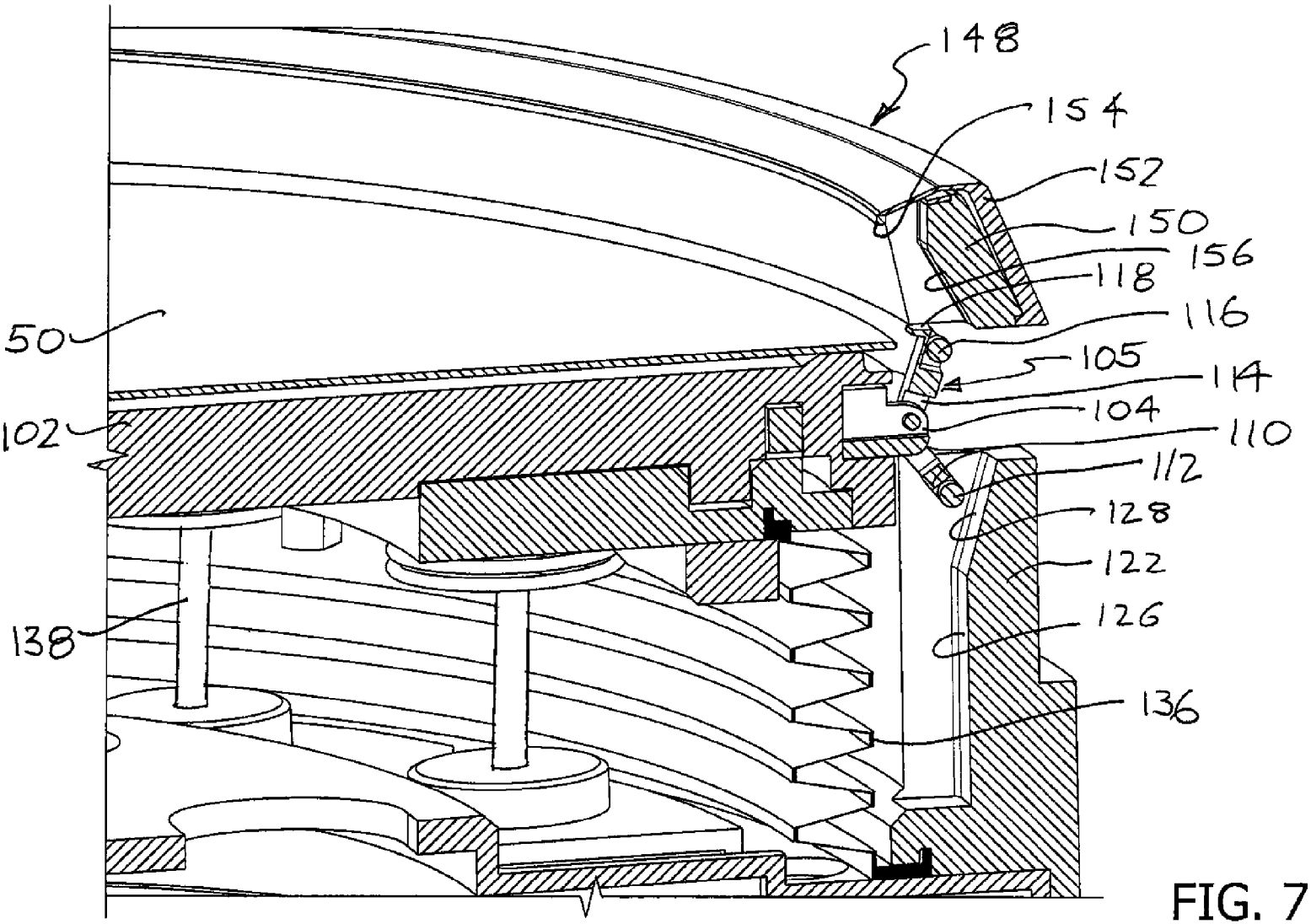
FIG. 7 is an enlarged section view of the rotor shown in FIGS. 4 and 5 with the backing plate in an intermediate position.
Figure 8:
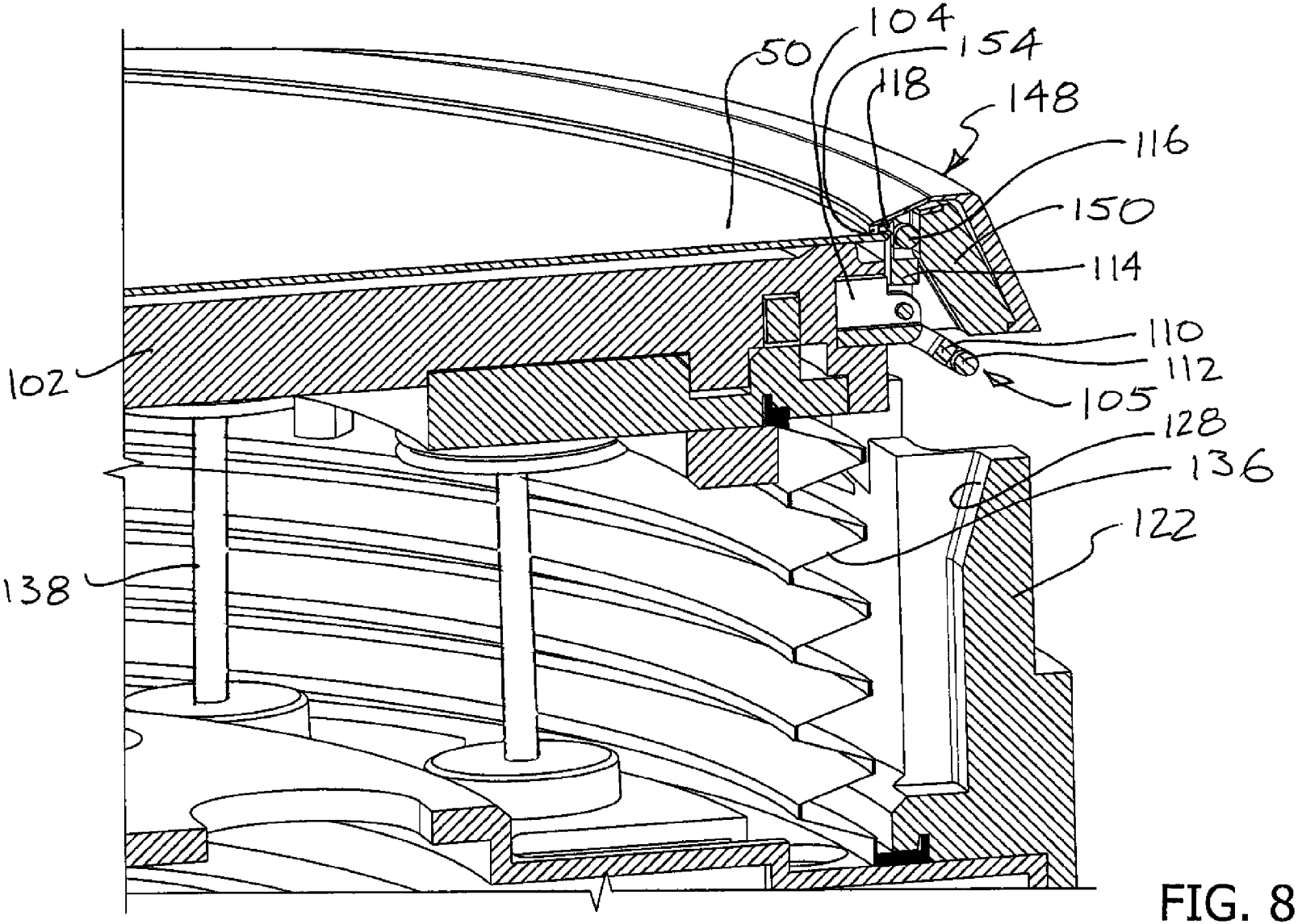
FIG. 8 is an enlarged section view of the rotor shown in FIGS. 4 and 5 with the backing plate fully extended, and with the wafer retainer shown engaged on the wafer.

Referring still to FIG. 6, the outer drive housing 122 has a vertical wall 126 joining into an outwardly angled wall 128 towards the lower ring assembly 148. The ring contact 150 has an inwardly angled wall 156. The backing plate ring 134 is sealed to the back of the backing plate. The backing plate ring 134 is in turn sealed against the outer drive housing 122 by a bellows 136. Standoffs 130 may be provided at the perimeter of the outer drive housing 122, to support the wafer 50 when the backing plate 102 is withdrawn, as shown in FIG. 6. An inner drive plate 140 is joined to the outer drive housing 122, and in turn to the spin motor 80 in the head 76. Referring momentarily to FIGS. 7 and 8, the backing plate 102 is supported on posts 138 attached to an actuator ring in the head, for movement along axis AA shown in FIG. 3.

FIGS. 6, 7, and 8 show the different positions of the backing plate 102 and one of the retainers 105, as the backing plate 102 is extended towards the lower ring assembly 148. FIG. 6 shows the position of the rotor components with the head 76 in a load/unload position. The head 76 is inverted, as shown in FIG. 2. The backing plate 102 is withdrawn into the outer drive housing 122. Referring to FIGS. 2 and 6, the process robot 70 moves the wafer 50 into the rotor 78 through the load slot 82. The robot 70 then moves down to place the wafer 50 onto the standoffs 130. The robot 70 then withdraws, leaving the wafer on the rotor 78, as shown in FIG. 6.

The actuator ring then drives the posts 138 out or up in FIG. 6. This moves the backing plate 102 and the wafer 50 towards the lower ring assembly 148. The retainer assembly 105 is engaged by the inwardly angled surface 156 on the ring contact 150. The roller 116 on the upper arm 114 (if used) contacts the angle surface 156. As the retainer 105 moves further up with movement of the backing plate, the finger 118 moves inwardly onto or over the top surface UF of the wafer 50. With the backing plate 102 fully extended and engaged against the lower ring assembly 148, the seal 154 seals around the edge of the top surface of the wafer 50. The finger 118 extends slightly radially inwardly (e.g., 1-5 or 2-4 mm) on the top surface of the wafer 50, just behind the seal 154. The contacts 155 (shown in FIG. 6) extend between the seal 154 and the top surface of the wafer 50, to make electrical contact with the top surface of the wafer 50.

With the rotor positioned as shown in FIG. 8, the rotate arm 74 supporting the head 76 is rotated to pivot the head 76 one-half turn, so that the head 76 is upright. The lift column 75 of the lift/rotate assembly 68 is then lowered to lower the head 76 into engagement with the base assembly 86, as shown in FIG. 3. The lower ring assembly 148 and the wafer 50 are immersed and rotated in a process liquid, such as a plating solution, contained within the bowl 88. The wafer 50 is then electro-plated with a metal, such as copper, as described, for example, in U.S. Pat. No. 6,911,127 B2, or United States Patent Application Publication No. US2005/0189213 A1, both incorporated herein by reference.

When the plating process is completed, the rotor 78 stops rotating and the head 76 is lifted up and out of the base assembly 86 by the lift column 75. The head 76 is then rotated back one-half turn to the inverted position shown in FIG. 8. The movement of the backing plate is reversed, with the backing plate withdrawing from the seal 154 as shown sequentially in FIGS. 8, 7 and 6. Ordinarily, with some processes, the wafer 50 may tend to stick to the seal 154. When this occurs, processing is interrupted because the wafer 50 cannot be picked up by the robot 70, unless the wafer 50 is in the load/unload position as shown in FIG. 6.

The retainers 105, however, prevent the wafer 50 from sticking to the seal 154. Specifically, as the backing plate 102 moves down and away from the seal 154, the fingers 118 on the retainers 105 hold the wafer 50 down onto the backing plate 102. Accordingly, as the backing plate 102 moves down, the wafer 50 necessarily moves down with the backing plate. Referring to FIGS. 7 and then 6, as the backing plate 102 moves down and further into the outer drive housing 122, the roller 112 on the lower arm 110 (if used) of the retainer 105 engages the outwardly angled wall 128. This causes the retainer 105 to pivot clockwise in FIG. 7. Consequently, the finger 118 is moved away from the edge of the wafer 50. The wafer 50 may then be picked up by the robot 70 for unloading from the head 76.

Figure 9:
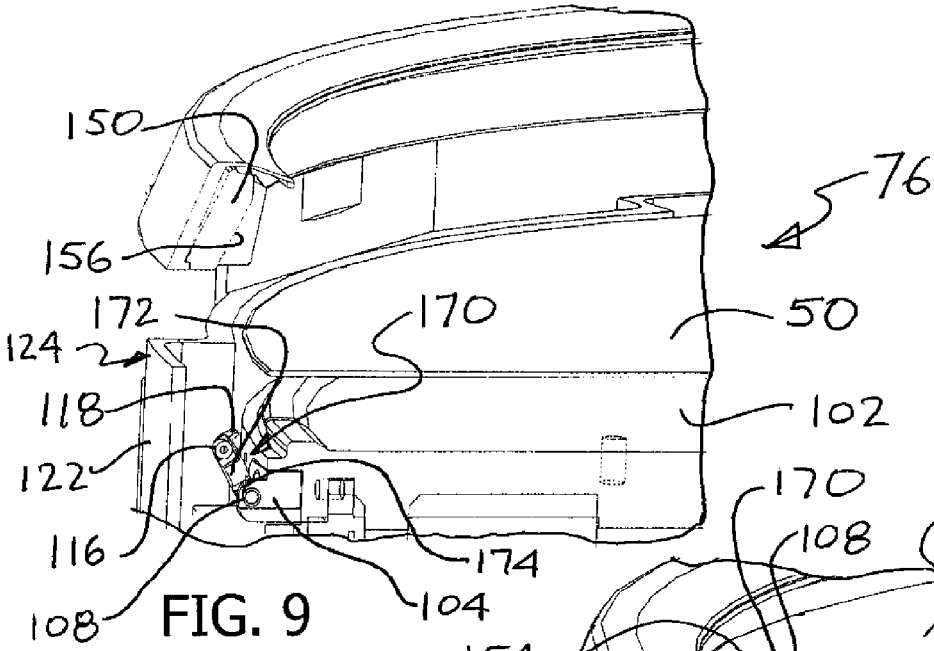
FIG. 9 is an enlarged section view of the rotor shown in FIGS. 4 and 5 with an alternative wafer retainer, and showing the backing plate withdrawn.
Figure 10:
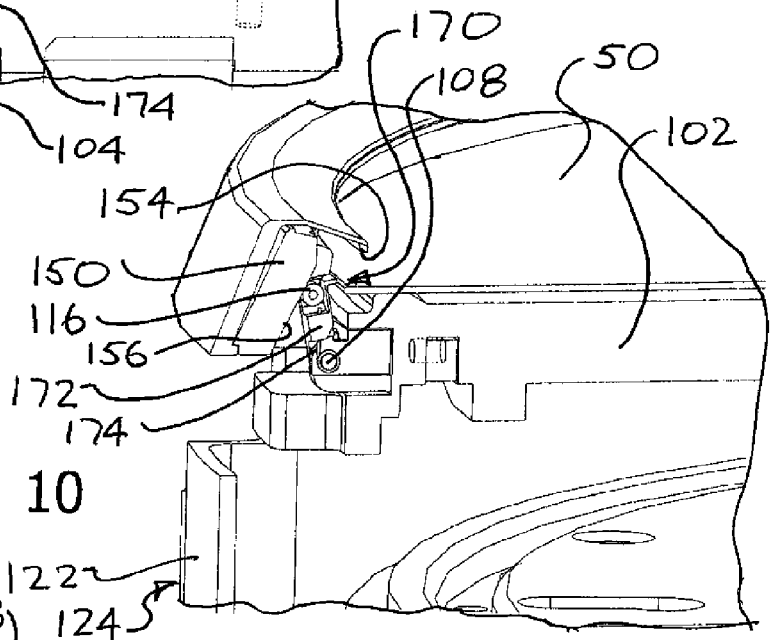
FIG. 10 is an enlarged section view of the rotor shown in FIGS. 4 and 5 with the alternative wafer retainer shown in FIG. 9, and showing the backing plate in an intermediate position.
Figure 11:
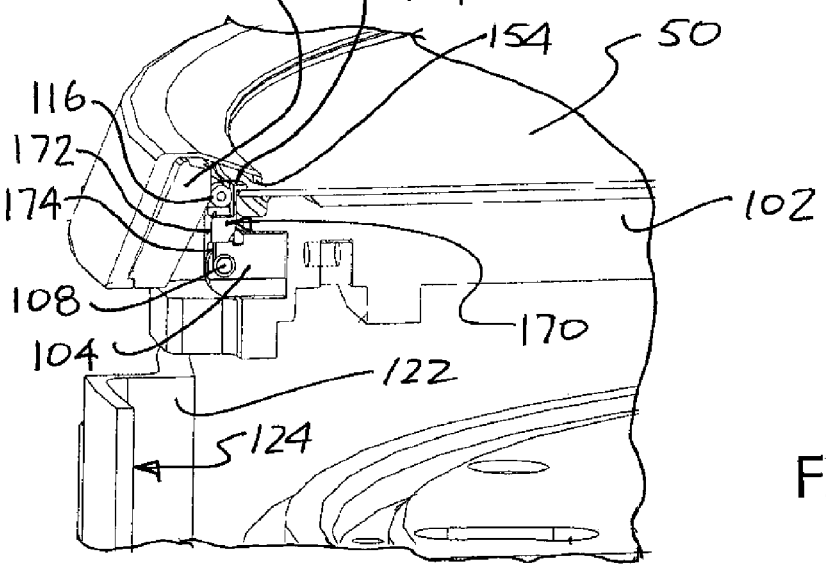
FIG. 11 is an enlarged section view of the rotor shown in FIGS. 4 and 5 with the alternative wafer retainer shown in FIG. 9, and showing the backing plate fully extended, and with the alternative wafer retainer shown engaged on the wafer.

FIGS. 9, 10, and 11 show an alternative retainer 170. The retainer 170 has a single arm 172 pivotably attached to the backing plate 102. A spring 174 urges the arm 170 radially outwardly, counterclockwise in FIGS. 9-11. As the backing plate 102 moves up, the finger 118 on the retainer 170 moves into engagement with the top surface of the wafer 50, in the same way as described above relative to the retainer 105. However, when the backing plate 102 moves down or away from the seal 154, the finger 118 releases the wafer 50 via the spring 174 pivoting the retainer radially outwardly and away from the wafer 50.

Thus novel methods and apparatus have been shown and described. Various changes and substitutions may of course be made, without departing from the spirit and scope of the invention. The invention, therefore, should not be limited, except by the following claims and their equivalents.

The invention claimed is:

1. A processor comprising:

a plate;

a plurality of wafer retainers, with substantially each wafer retainer attached to the plate via a pivot joint;

a ring moveable relative to the plate; and a ring angle surface on the ring contacting and pivoting substantially each wafer retainer to move a finger on the wafer retainer towards a first side of the plate as the plate and the ring move relatively towards each other.

2. A processor comprising:

a plate adapted to support a wafer during processing, by contacting a second side of the wafer;

a plurality of wafer retainers, with substantially each wafer retainer attached to the plate via a pivot joint;

a ring, with the ring and the plate moveable relative to each other;

a seal on the ring for making sealing contact with a first side of a wafer supported on the plate; and a ring angle surface on the ring contacting and pivoting substantially each wafer retainer to move a finger on the wafer retainer into contact with the first side of the wafer, with movement of at least one of the plate and the ring towards the other, along a first axis.

3. The processor of claim 2 further comprising a spring associated with substantially each wafer retainer biasing the finger away from the first side of the wafer.

4. The processor of claim 2 with the wafer retainer comprising a roller engageable against the ring angle surface.

5. The processor of claim 2 wherein the fingers contact the wafer at finger positions adjacent to an edge of the wafer, and the seal contacts the wafer at positions between a center of the wafer and the finger positions.

6. The processor of claim 2 with substantially each wafer retainer having a first arm and a second arm, and with the ring angle surface oriented at an angle A to the first axis, and with the plate supported in a head having a head angle surface oriented at an angle B, and with the first arm having a first end contacting the ring angle surface as the plate and ring move toward each other, to move the finger into engagement over the first surface of the wafer, and the second arm having a second end contacting the head angle surface as the plate is withdrawn into the head, to disengage the finger from the first surface of the wafer.

7. The processor of claim 6 with the first arm extending at angle to the second arm.

8. A processor comprising:

a head having a rotor;

a spin motor in the head for spinning the rotor about a spin axis;

a backing plate on the rotor;

a plurality of wafer retainers spaced apart around a circumference of the backing plate and pivotally attached to the backing plate;

an inwardly extending finger on substantially each of the wafer retainers;

one or more actuators adapted to move the backing plate in a direction generally parallel to the spin axis;

an outer ring on the head having a wafer retainer housing associated with substantially each wafer retainer, and with each wafer retainer housing having an outwardly oriented angle surface;

an electrode ring on the head and having an inwardly oriented angle surface associated with substantially each wafer retainer;

a seal on the electrode ring;

a lift/rotate mechanism attached to the head; and a base having a bowl for holding an electrolyte, and with the backing plate moveable into the bowl via actuation of the lift/rotate mechanism.

9. The processor of claim 8 with substantially each wafer retainer having a first end engageable against the inwardly oriented angle surface on the electrode ring, as the backing plate moves towards the electrode ring, to move the finger into engagement with a wafer on the backing plate.

10. The processor of claim 9 with substantially each wafer retainer having a second end engageable against the outwardly oriented angle surface of a wafer retainer housing, as the backing plate is withdrawn at least partially into the head.

11. The processor of claim 10 further comprising a first roller on the first end of substantially each of the wafer retainers, and a second roller on the second end of substantially each of the wafer retainers.

12. The processor of claim 9 with the seal contacting a first side of a wafer on the backing plate inwardly from the edge of the wafer by a first dimension, and with substantially each finger contacting the first side of the wafer inwardly from the edge of the wafer by a second dimension less than the first dimension.

13. The processor of claim 9 with the electrode ring including an annular electrode, and with the inwardly oriented angle surface formed on the electrode.

14. The processor of claim 10 where withdrawing the backing plate into the head causes a wafer on the backing plate to separate from the seal before the second end of substantially each retainer contacts the outwardly oriented angle surface.

15. The processor of claim 9 with each wafer retainer housing further comprising a straight wall section oriented substantially parallel to the spin axis.

* * * * *